US009903085B2

(12) United States Patent
Deroos et al.

(10) Patent No.: US 9,903,085 B2
(45) Date of Patent: Feb. 27, 2018

(54) PILE REPAIR CLAMP

(71) Applicant: 4D TECH SOLUTIONS, INC., Morgantown, WV (US)

(72) Inventors: Bradley G. Deroos, Fairmont, WV (US); Kirill Speransky, Morgantown, WV (US); Patrick Donovan, California, MD (US)

(73) Assignee: 4D TECH SOLUTIONS, INC., Morgantown, WV (US)

( * ) Notice: Subject to any disclaimer, the term of this patent is extended or adjusted under 35 U.S.C. 154(b) by 0 days.

(21) Appl. No.: 15/067,758

(22) Filed: Mar. 11, 2016

(65) Prior Publication Data

US 2016/0298310 A1 Oct. 13, 2016

Related U.S. Application Data

(60) Provisional application No. 62/131,581, filed on Mar. 11, 2015.

(51) Int. Cl.
*E02D 5/64* (2006.01)
*E02D 5/30* (2006.01)

(52) U.S. Cl.
CPC *E02D 5/30* (2013.01); *E02D 5/64* (2013.01)

(58) Field of Classification Search
CPC ..... E02D 5/60; E02D 5/64; E02D 5/226
USPC ..... 405/211, 211.1, 216
See application file for complete search history.

(56) References Cited

U.S. PATENT DOCUMENTS 2,636,354 A * 4/1953 Glassgold ..... E02D 5/64 405/12
3,003,646 A * 10/1961 Wolf ..... A47F 5/04 211/107
3,505,825 A * 4/1970 Colby ..... E02D 5/64 249/90
4,048,779 A * 9/1977 Valenziano ..... E02D 5/64 174/45 R
4,116,013 A * 9/1978 Hellmers ..... E02D 5/64 405/216
4,439,070 A * 3/1984 Dimmick ..... E02D 5/64 24/271
4,474,129 A * 10/1984 Watkins ..... B63B 21/663 114/243

(Continued)

FOREIGN PATENT DOCUMENTS

CA 2539163 A1 * 3/2005 ..... E02D 5/64
WO WO 2016008006 A1 * 1/2016 ..... E02D 5/00

*Primary Examiner* — Frederick L Lagman
(74) *Attorney, Agent, or Firm* — Birch, Stewart, Kolasch & Birch, LLP

(57) ABSTRACT

A pile repair apparatus includes a metal clamp having left and right brackets connected by a hinge member. A friction surface is positioned along an inner surface of the metal clamp to improve the connection of the apparatus to a pile to be repaired. A platform is connected to a top surface of the metal clamp, and a means for providing neutral buoyancy to the pile repair apparatus can be secured to the platform. The neutral buoyancy of the apparatus allows a diver to move and to submerse the apparatus easily and to position the apparatus around a pile to be repaired by opening and closing the apparatus about the hinge member. The apparatus is secured to the pile by inserting a bolt through corresponding apertures in the left and right brackets of the apparatus.

16 Claims, 8 Drawing Sheets

(56) References Cited

U.S. PATENT DOCUMENTS 4,612,056 A * 9/1986 Gibson ..... E02B 17/0017 134/6
4,631,039 A * 12/1986 Meriwether ..... F16L 1/24 441/133
4,679,964 A * 7/1987 Blandford ..... E02B 17/027 166/356
4,993,876 A * 2/1991 Snow ..... E02B 17/0034 405/216
5,226,751 A * 7/1993 Doleshal ..... E02D 5/60 405/211.1
5,337,469 A * 8/1994 Richey ..... E02D 5/64 29/402.08
5,460,463 A * 10/1995 Smith ..... E02D 5/60 405/212
5,954,305 A * 9/1999 Calabro ..... H01Q 1/1242 248/219.4
6,270,387 B1 * 8/2001 Nesheim ..... E21B 17/012 405/211
6,371,696 B1 * 4/2002 Eathorne ..... B63B 59/10 405/211
6,725,972 B1 * 4/2004 Krier ..... A01M 31/02 182/187
7,168,673 B1 * 1/2007 Piemonte ..... E02D 5/226 248/218.4
7,431,535 B2 * 10/2008 Cupolillo ..... E21B 17/1035 166/241.1
7,617,792 B1 * 11/2009 Pursley ..... E02B 3/26 114/219
7,744,314 B2 * 6/2010 Eide ..... E21B 17/012 166/350
8,002,501 B2 * 8/2011 Dos Santos ..... B63C 11/52 405/211
8,628,275 B1 * 1/2014 Trader ..... E02D 5/64 405/211
8,833,521 B1 * 9/2014 Jude ..... A01M 31/02 182/12
2004/0075037 A1 * 4/2004 Krier ..... A01M 31/02 248/523
2013/0294841 A1 * 11/2013 Fey ..... E02D 5/60 405/216

* cited by examiner

PILE REPAIR CLAMP

CROSS REFERENCE TO RELATED APPLICATIONS

This application claims the benefit of U.S. provisional application No. 62/131,581, filed Mar. 11, 2015, the contents of which are incorporated herein by reference.

FIELD OF INVENTION

The present application relates to repairing structures, and more specifically to a method and apparatus wherein the structure is protected or strengthened by a shell or facing constructed on or assembled to the exterior of the structure, or by a substance applied to the exterior to form a layer thereon.

BACKGROUND

Concrete pilings and piers are utilized in industrial, bridge and marine construction projects due to their strength, corrosion resistance and ability to withstand long term exposure to adverse elements. However, over time these pilings and piers can deteriorate due to factors such as corrosion from salt intrusion, exposure to salt water, marine life and extreme weather conditions, or can become damaged from collisions with vehicles including ships and land vehicles. When a concrete pile or pier is damaged or deteriorated, it may be necessary to reinforce the outer surface of the pile or pier with new concrete, epoxy, or other structural repair material.

The process of repairing a pile or pier (collectively referred to hereafter as "pile") typically involves the use of various pieces of custom built equipment and, in marine environments, the need for underwater divers to access the damaged area and to effectuate a repair. There are currently three major problems with the traditional repair process. First, the platform used to support the rebar and jacket (also known as a "form") used to contain concrete, epoxy, or other repair material is very time-consuming to install. Second, concrete, epoxy, or other repair material can leak out from beneath the jacket due to platform-to-jacket alignment issues. Third, the clamping force between the platform and pile is not consistently applied which can result in slippage of the platform when the jacket is filled. As a result, there is a need in the industry for an improved and simplified apparatus and method for repairing pile that does not require difficult and time consuming labor.

SUMMARY

The present invention solves the foregoing problems by providing a pile repair apparatus that can be pre-assembled on dry land and positioned easily around a pile to be repaired. For marine applications an additional flotation member can be added to achieve neutral buoyancy thereby enhancing underwater movement of the present invention.

One aspect of the invention is an apparatus, including a clamp made of metal or some other form of material, such as composites, sufficiently strong to sustain the required clamping forces; a friction member positioned along an inner surface of the clamp; and a platform connected to a top surface of the clamp. The apparatus may further include a means for providing neutral buoyancy to the apparatus.

A second aspect of the invention is an apparatus, including a clamp comprising left and right brackets connected by a hinge member; a friction member positioned along an inner surface of the clamp; a platform connected to a top surface of the clamp; and a means for providing neutral buoyancy to the pile repair apparatus.

A third aspect of the invention is a method for repairing a pile, including securing a friction member along an inner surface of a clamp adapted to wrap around a pile, pier or other structure to be repaired; connecting a platform to a top surface of the clamp; and securing the clamp to the pile, pier or other structure to be repaired.

The entire apparatus can be preassembled in a dry environment to ensure a high-quality platform is installed underwater. A single clamp assembly can support an entire structural repair load, including, but not limited to, concrete, epoxy, and other structural repair material without slippage of the clamp on the pile. A removable flotation member can be attached to the top of the platform to provide neutral buoyancy to the entire assembly, which makes it easy for divers to maneuver the clamp into position anywhere along the pile. Once in position, by virtue of the geometry and load path of the clamping force, the platform self-aligns to the pile to prevent leakage when the concrete, epoxy, or other repair material is poured. A tedious platform installation process that can take several hours to complete can be performed in a significantly shortened time period using the apparatus described herein.

BRIEF DESCRIPTION OF THE DRAWINGS

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
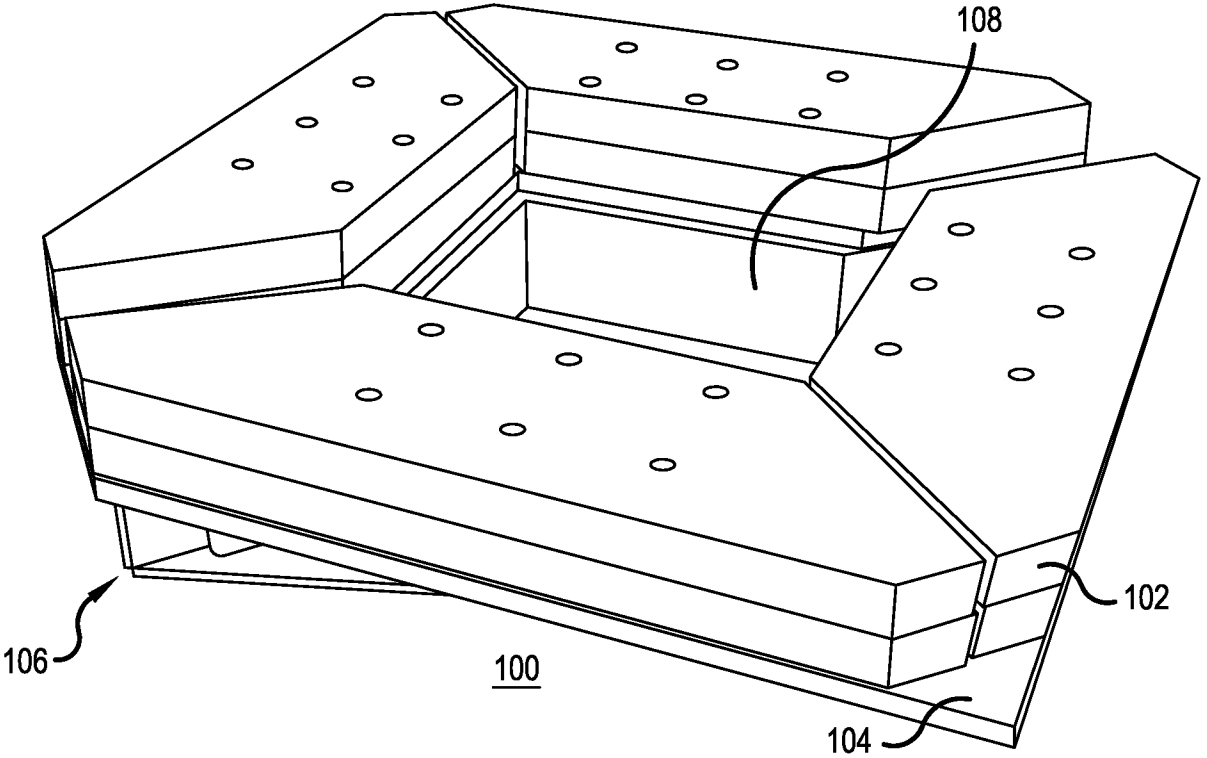
FIG. 1 is a top perspective view of an apparatus of the present invention.
Figure 8:
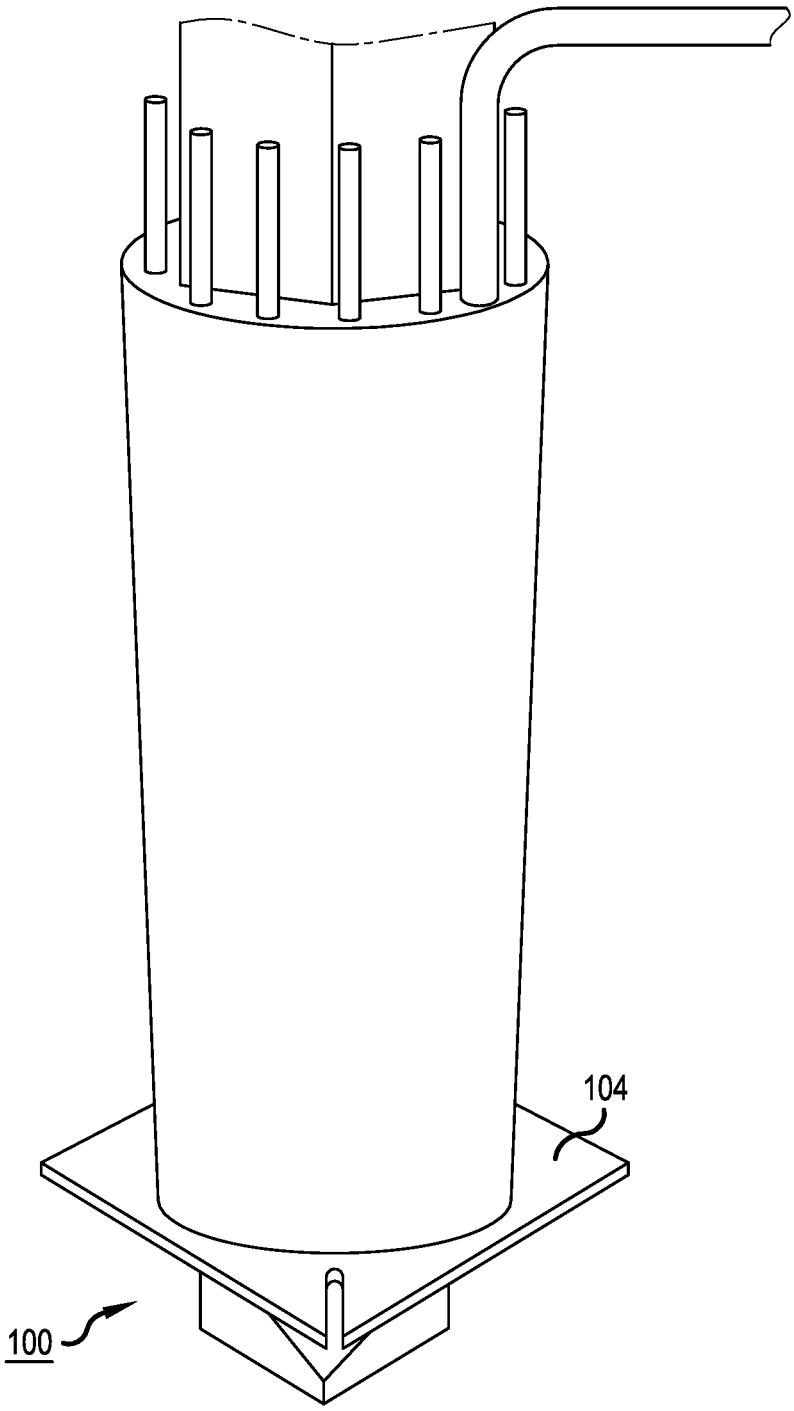
FIG. 8 illustrates an embodiment of the apparatus of the invention applied to a marine pile.

An apparatus of the invention (or "apparatus") 100 is shown generally in FIG. 1. The apparatus 100 optionally but preferably includes a flotation member 102 secured to a platform 104. The platform 104 is positioned atop a clamp 106 that is adapted for mounting the apparatus 100 to a pile, pier or other structure to be repaired as shown in FIG. 8. For purposes of this application, "pile" shall refer to marine pile or piling, piers, towers, and any other structure capable of being repaired by adding concrete, epoxy, or other suitable repair material to its circumference or perimeter. A friction member 108 is provided within the interior of the clamp 106 to enhance the connection of the clamp 106 to the pile.

Clamp

Figure 2:
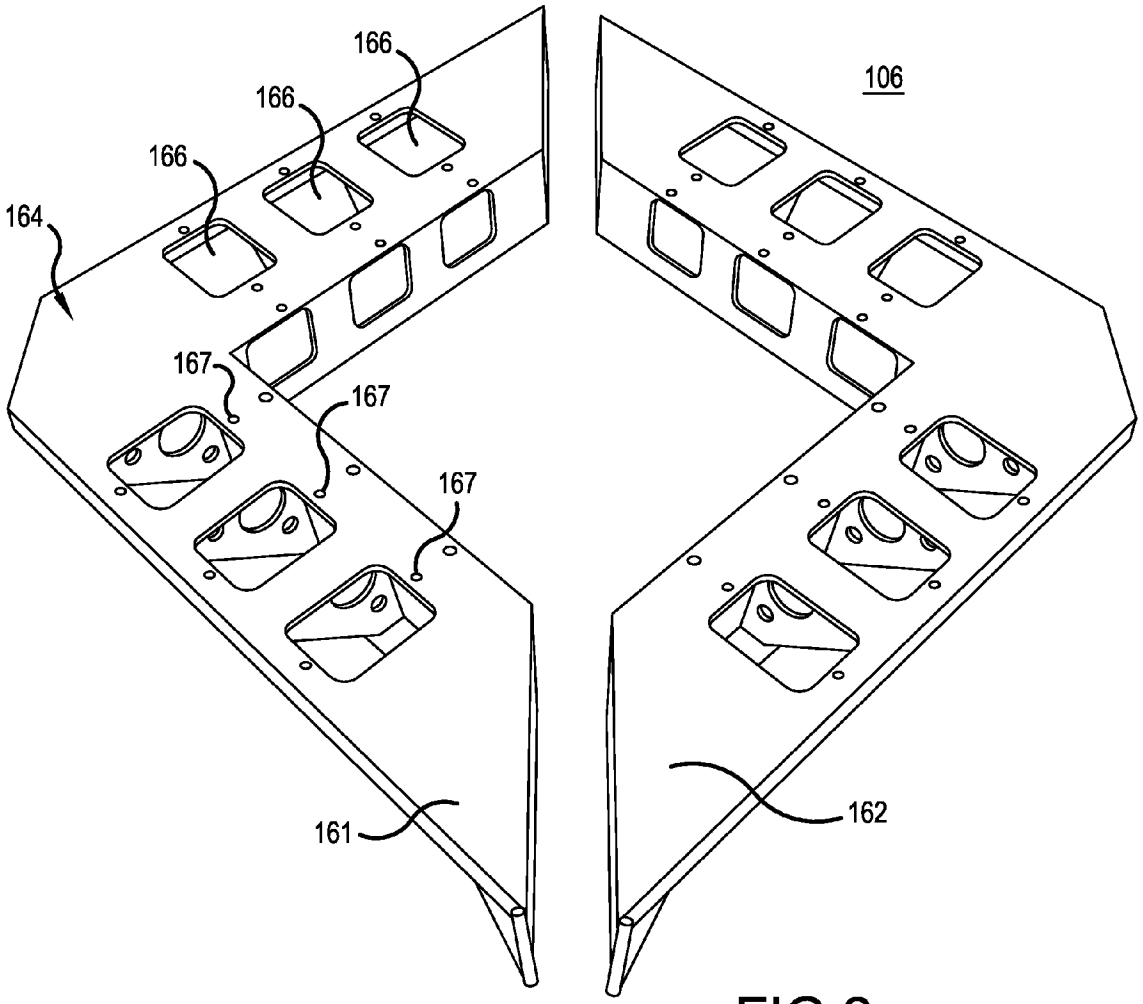
FIG. 2 is a top perspective view of left and right brackets of the apparatus.

As shown more clearly in FIG. 2, the clamp 106 optionally but preferably includes a left bracket 161 and a right bracket 162 that are for practical purposes mirror images of one another, and, which when combined with friction member 108, have an inside dimension that corresponds to the outside dimension of a pile to be repaired. The left and right brackets 161, 162, respectively, are optionally but preferably detachably secured to one another by a hinge member 463. Each of bracket 161, 162 has a top surface 164 and a bottom surface 365. The top surface 164 has a generally uniform width adapted for accommodating the platform 104. The top surface 164 further has one or more apertures 166 that serve to lessen the overall system weight and a plurality of holes 167 that correspond to holes in the platform 104.

Figure 3:
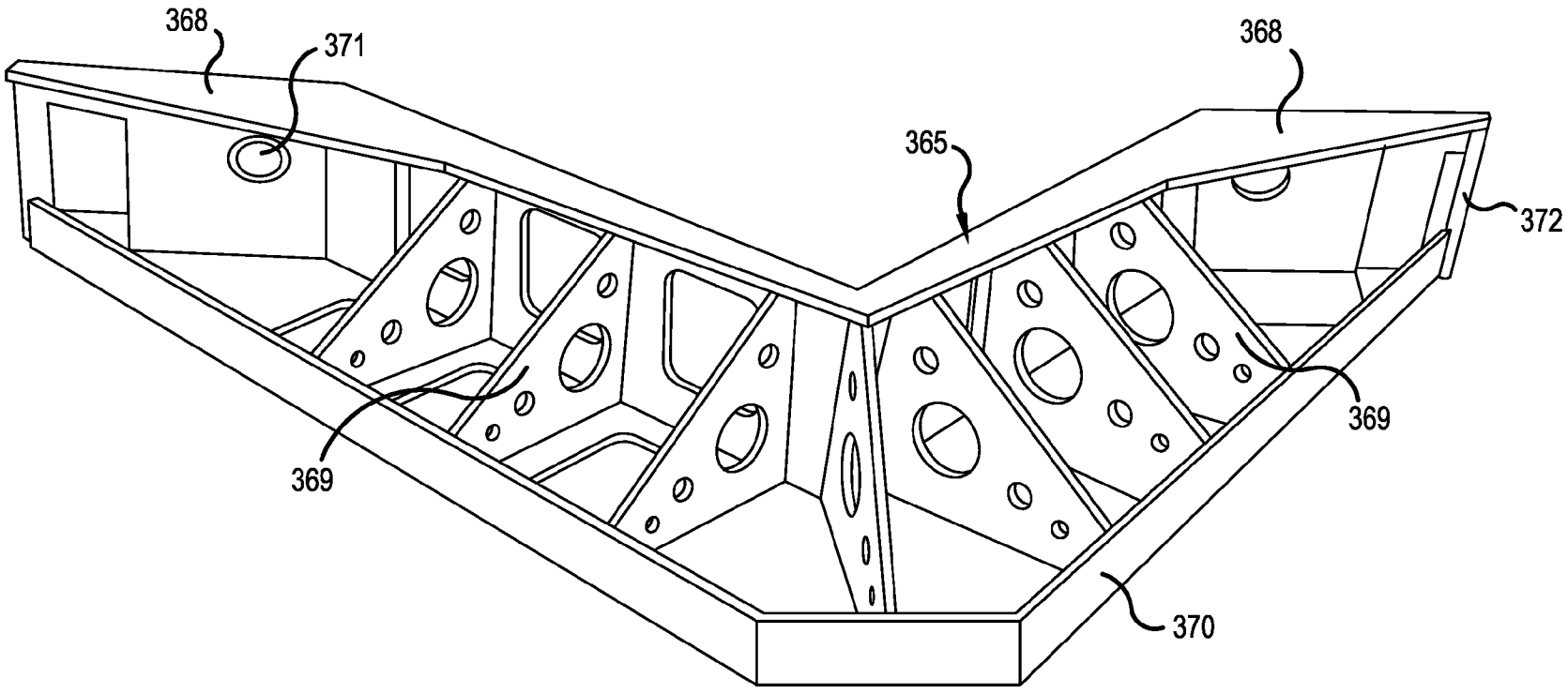
FIG. 3 is a side perspective view of one of the brackets.
Figure 4:
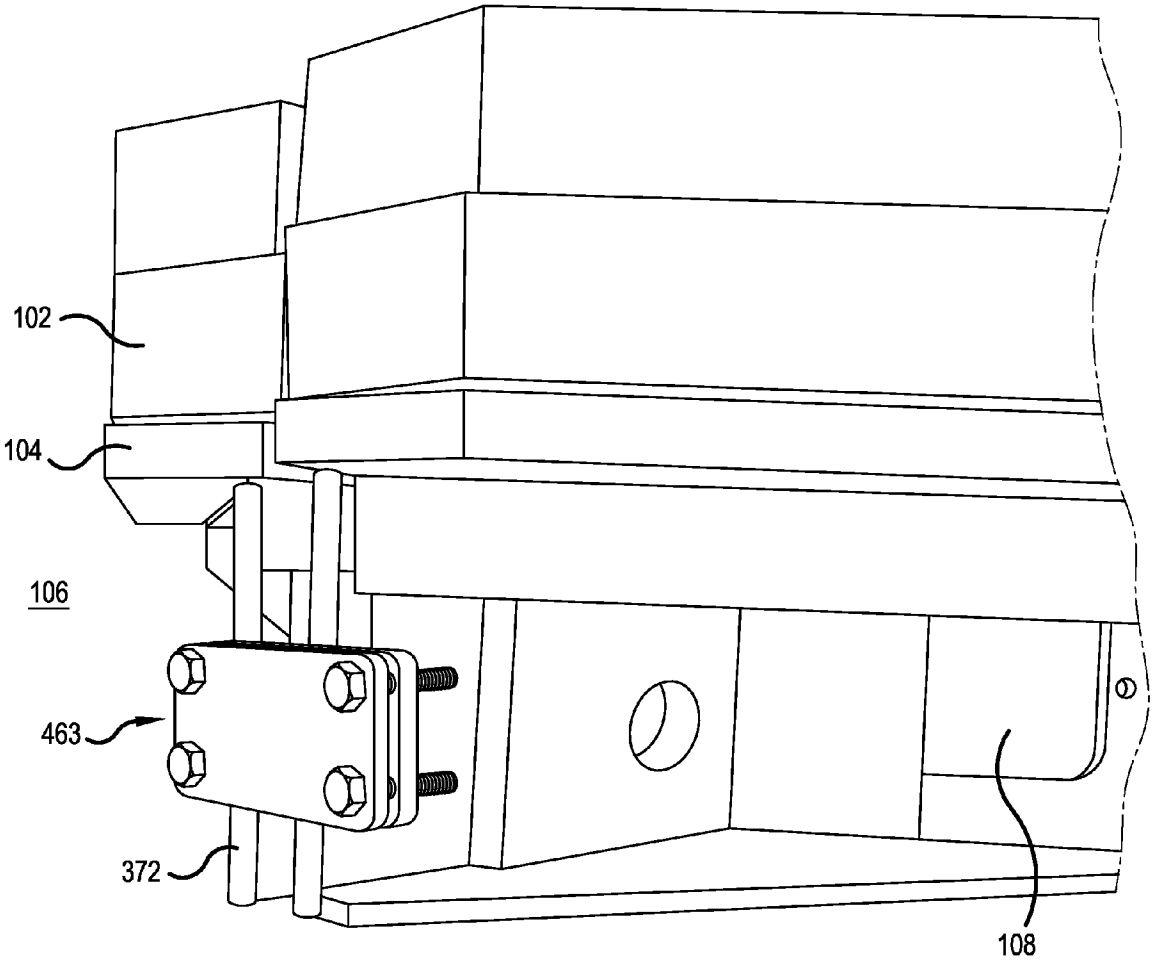
FIG. 4 is a side perspective view of a hinge member connecting the left and right brackets.

FIG. 3 shows the bottom surface 365 of one of the brackets 161, 162. The bottom surface 365 has one or more bottom plates 368 positioned at the bottom surface 365 of the clamp 106. One or more ribs 369 extend vertically between the top and bottom surfaces 164, 365 of the bracket 161. A band 370 extends along the length of the top surface 164 of the bracket 161. The first and second side bracket 161 and 162 contain a nut 371 on an angled side plate 373 for receiving a bolt. On the mirrored side of the first and second side bracket 161 and 162, a clearance hole 374 is provided to allow the threaded portion of a bolt to pass through the angled side plate 373, with the head of the bolt, or alternatively a washer under the head of the bolt, exerting a force on the angled side plate when torqued. One side of the bracket 161 and 162 has one or more rods 372 adapted for forming a hinge 463 to enhance installation of the apparatus 100 to a pile. An example of a hinge 463 is shown more clearly in FIG. 4.

Friction Surface

Figure 5:
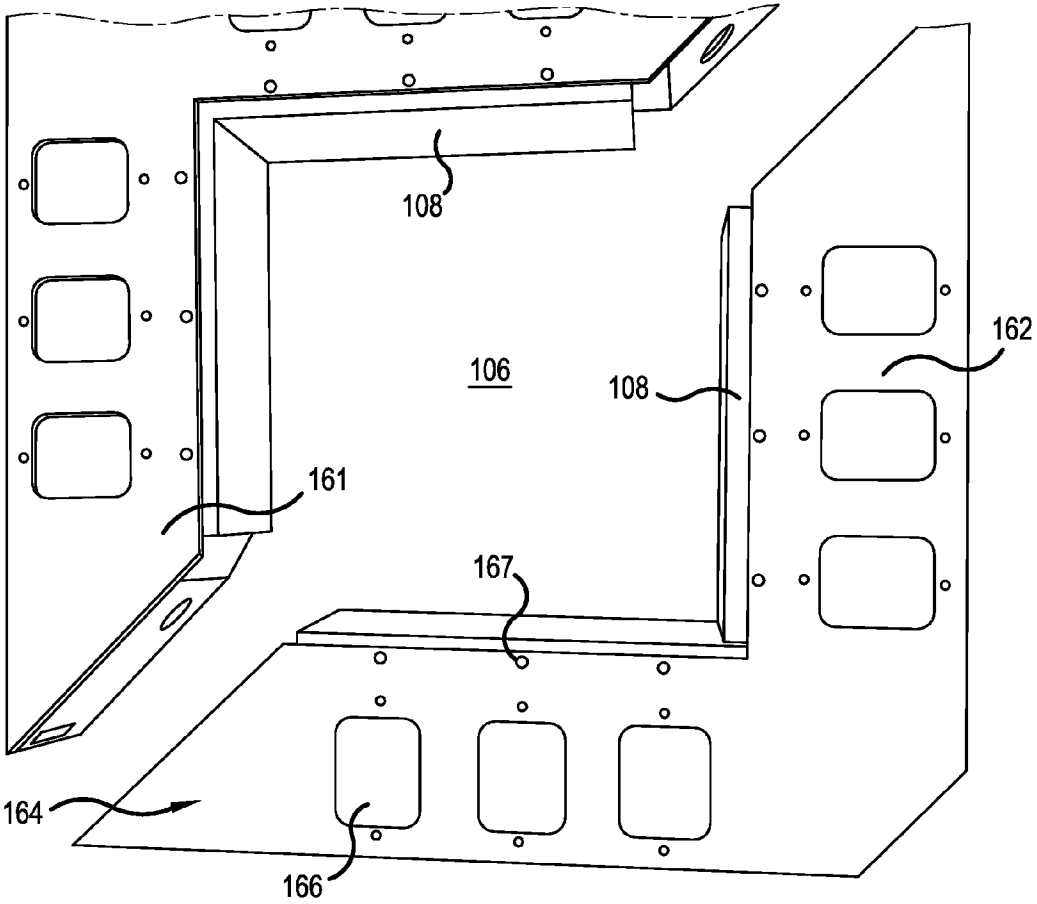
FIG. 5 is a top perspective view showing friction surfaces secured to the left and right brackets.

Referring to FIG. 5, a friction member 108, such as wood, rubber, plastic or other synthetic material with a high coefficient of friction, can be secured to the inside surface of the clamp brackets 161, 162. In a preferred embodiment, the friction member 108 is one or more wood planks dimensioned to fit inside the inner surface of the brackets 161, 162. The friction member 108 contacts the outer surface of a pile to be repaired and improves the connection between the apparatus 100 and the pile.

Platform

Figure 6:
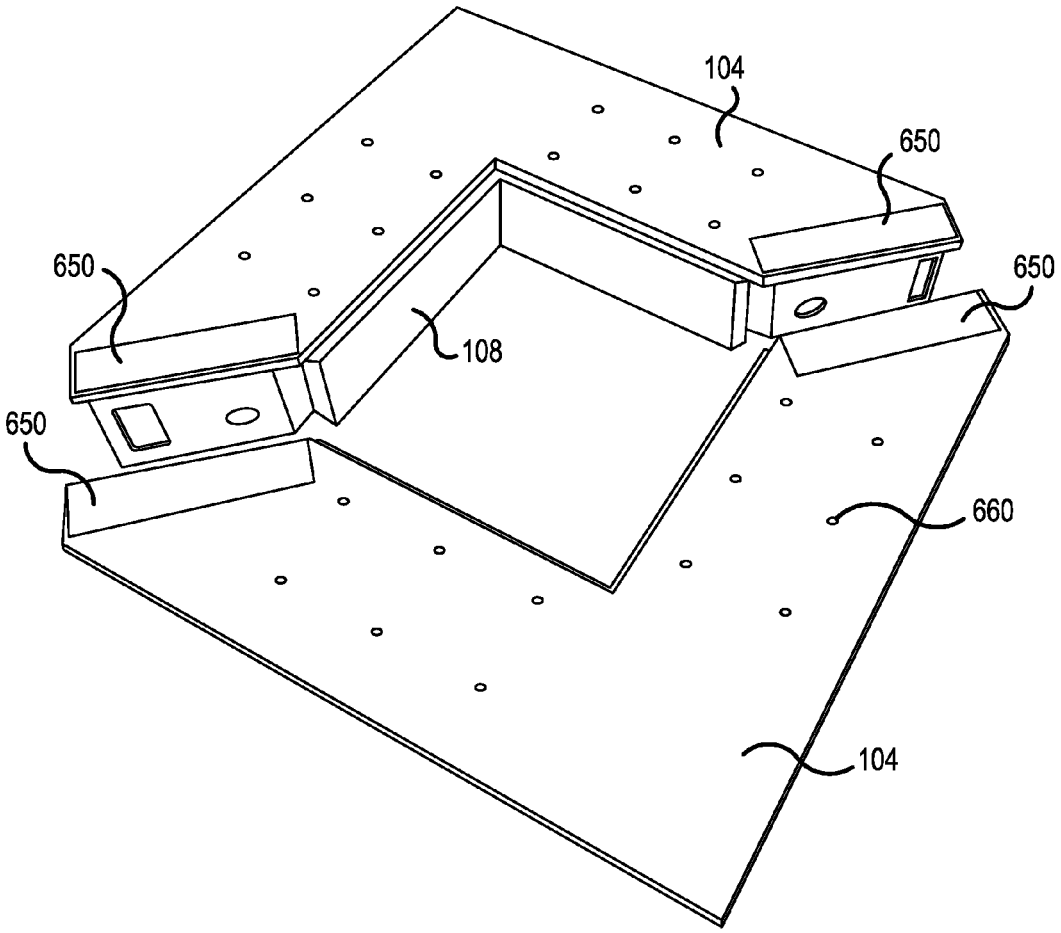
FIG. 6 is a top perspective view of one or more platforms connected to the left and right brackets.

As shown in FIG. 6, one or more platforms 104 can be connected to the top surface 164 of each of the brackets 161, 162. The platform optionally but preferably is a wood panel having a width equal or greater than the width of the top surface 164 of the brackets 161, 162. The platform has holes 660 that correspond to the holes 167 in the top surface 164 of the brackets 161, 162. The platform 104 further can include hook and loop closures 650 adapted for receiving a corresponding hook and loop closure.

Means for Providing Neutral Buoyancy

Figure 7:
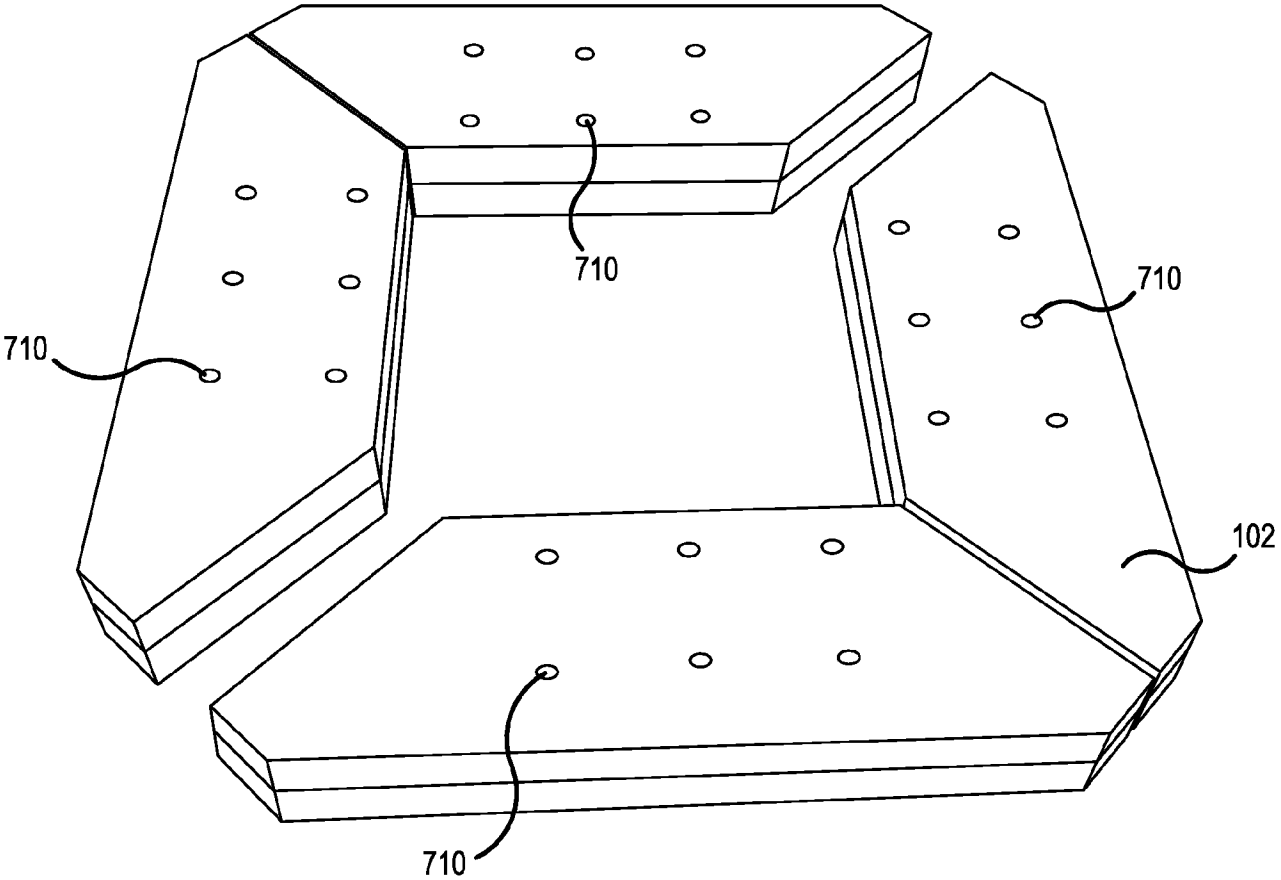
FIG. 7 is a top perspective view of the means for providing neutral buoyancy the apparatus.

An example of a means for providing neutral buoyancy to the apparatus 100 is shown in FIG. 7. In a preferred embodiment, the means for providing neutral buoyancy is a flotation member 102 made of foam or other buoyant material, such as, but not limited to, polyethylene, cross-linked polyethylene, polyurethane foams, detachably secured to the platform 104. The flotation member 102 has a plurality of holes 710 that correspond to the holes 660 in the platform 104. The flotation member 102 and platform 104 can be connected by zip ties, bungie cords, rope, wire, or other appropriate fastening means.

In operation, the left and right brackets 161, 162 of the apparatus 100 are clamped together by bolts or other mechanical closure mechanism of sufficient strength to provide adequate clamping forces. The hinge member 463 allows the apparatus 100 to be opened and to be positioned around a pile to be repaired. One or more friction members 108 is secured to the inner surface of the left and right brackets 161, 162 of the clamp 106. One or more platforms 104 is secured to the top surface 164 of each of the left and right brackets 161, 162. If the repair is to be performed under water or if the apparatus otherwise must be transported in water, a flotation member 102 can be attached to the platform 104. The flotation member 102 makes the apparatus 100 neutrally buoyant, which allows a diver to easily transport and submerse the apparatus 100 when commencing to repair a pile. Once in a desired location, and after tightening of the bolts or other mechanical closure mechanism, the flotation member 102 can be removed by cutting or otherwise severing the mechanical fastening means affixing the flotation member 102 to the platform 104. The apparatus 100 can be opened about its hinge member 463 and placed around a section of pile to be repaired. The friction member 108 enhances the connection of the apparatus 100 to the pile. The apparatus 100 is secured in place around the pile by inserting bolts between the left and right brackets 161, 162. Once in place, with the bolts or other mechanical closure mechanism tightened, the apparatus 100 self-aligns to the pile to prevent leakage when concrete, epoxy, or repair material is poured during the repair process. The apparatus 100 can be moved easily along the pile by removing or loosening the bolt between the left and right brackets 161, 162 and sliding the apparatus 100 up or down along the pile as needed. Any gap between the left and right brackets, 161, 162, which may exist due to variation in the outside dimension of piles to be repaired, may be closed by affixing a corresponding hook and loop closure to the hook and loop closure 650 on the platform 104.

CONCLUSION

While various preferred embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above.

What is claimed is:

1. A pile repair apparatus, comprising:

a clamp;

a friction member positioned along an inner surface of the clamp;

a platform connected to a top surface of the clamp; and a hook and loop closure on a top surface of the platform.

2. The pile repair apparatus of claim 1, further comprising a means for providing neutral buoyancy to the apparatus.

3. The pile repair apparatus of claim 2, wherein the means for providing neutral buoyancy is a flotation member.

4. The pile repair apparatus of claim 3, wherein the flotation member is foam.

5. The pile repair apparatus of claim 1, wherein the clamp comprises left and right brackets.

6. The pile repair apparatus of claim 5, wherein the left and right brackets of the clamp are secured to one another by a hinge member.

7. The pile repair apparatus of claim 5, wherein each of the left and right brackets comprises an aperture adapted for receiving a bolt.

8. The pile repair apparatus of claim 5, wherein the left and right brackets of the clamp each comprise a top surface with one or more holes corresponding to holes in the platform and adapted for connecting the platform to the clamp.

9. The pile repair apparatus of claim 1, wherein the platform comprises one or more holes corresponding to holes in the means for providing neutral buoyancy and adapted for connecting neutral buoyancy means to the platform.

10. The pile repair apparatus of claim 9, wherein the platform and neutral buoyancy means are connected to one another by zip ties extended through the corresponding holes.

11. A pile repair apparatus, comprising:

a clamp comprising left and right brackets connected by a hinge member;

a friction member positioned along an inner surface of the metal clamp;

a platform connected to a top surface of the metal clamp; and a means for providing neutral buoyancy to the pile repair apparatus; wherein the top surface of the brackets comprises one or more holes corresponding to holes in the platform and adapted for connecting the platform to the clamp.

12. The pile repair apparatus of claim 11, wherein each of the left and right brackets comprises a top surface and a bottom surface, and one or more ribs extending vertically between the top surface and bottom surface.

13. The pile repair apparatus of claim 11, wherein each of the left and right brackets comprises an aperture adapted for receiving a bolt.

14. The pile repair apparatus of claim 11, wherein the means for providing neutral buoyancy is a flotation member.

15. The pile repair apparatus of claim 14, wherein the flotation member is foam.

16. The pile repair apparatus of claim 11, wherein the platform comprises one or more holes corresponding to holes in the means for providing neutral buoyancy and adapted for connecting neutral buoyancy means to the platform.

* * * * *